United States Patent [19]

McCormick

[11] Patent Number: 5,048,735

[45] Date of Patent: Sep. 17, 1991

[54] FIREARM HOLSTER LOCKING APPARATUS AND METHOD

[76] Inventor: Michael L. McCormick, 7506 Bender Dr., Austin, Tex. 78749

[21] Appl. No.: 639,366

[22] Filed: Jan. 10, 1991

Related U.S. Application Data

[63] Continuation of Ser. No. 447,361, Dec. 6, 1989, abandoned.

[51] Int. Cl.[5] ..... F41C 33/02

[52] U.S. Cl. ..... 224/244; 224/911

[58] Field of Search ..... 224/244, 243, 242, 911

[56] References Cited

U.S. PATENT DOCUMENTS

| | | | |
|---|---|---|---|
| 1,635,984 | 7/1927 | Corriston | 224/244 |
| 3,550,822 | 12/1970 | Lloyd | 224/911 |
| 3,669,325 | 6/1972 | Furman | 224/243 |
| 3,866,811 | 2/1975 | Hamby | 224/244 |
| 4,256,243 | 3/1981 | Bianchi et al. | 224/244 |
| 4,277,007 | 7/1981 | Bianchi et al. | 224/244 |
| 4,846,384 | 7/1989 | Perry | 224/244 |

*Primary Examiner*—Linda J. Sholl

*Attorney, Agent, or Firm*—J. Nevin Shaffer, Jr.; Russell D. Culbertson

[57] ABSTRACT

A locking apparatus is adapted for locking a firearm or the like received in a holster, so that the firearm may not move appreciably while received in the holster and so that the firearm may be quickly withdrawn. The locking apparatus is particularly useful with speed holsters which provide minimal support for the weapon received therein. The preferred locking apparatus includes an activating member connected to a locking member. A suitable clamp or base member connects the activating and locking members to an inside surface of the holster. The locking apparatus is adapted to be positioned in an unlocked position in which the activating member extends generally transversely into the holster in position to be contacted as a firearm is inserted, and in which the locking member is retracted so as to lie generally adjacent an inner surface of the holster. Further, the locking apparatus is adapted to be moved to a locked position as a firearm is inserted into the holster, with the activating member displaced downwardly and the locking member extended into the holster so as to contact the firearm and retain it securely against a portion of the holster.

19 Claims, 2 Drawing Sheets

FIREARM HOLSTER LOCKING APPARATUS AND METHOD

This application is a continuation of application Ser. No. 447,361, filed Dec. 6, 1989, now abandoned.

BACKGROUND OF THE INVENTION

The invention relates to firearm holsters and particularly to locking devices for preventing a firearm received in a holster from rocking or moving within the holster, while allowing the firearm to be withdrawn quickly. The invention also encompasses methods for retaining a firearm properly in position in a holster so that it may not rock or slide back and forth within the holster, and so that the firearm may be withdrawn quickly.

Firearms, and particularly pistols, have for many years been carried in holsters of various types. Such holsters are still used today by security guards, law enforcement officers, and military personnel, and are also used in certain types of target shooting competition. Holsters generally include a receptacle for receiving at least a portion of the firearm with an opening through which the firearm may be inserted and withdrawn.

The ability to draw the firearm quickly is often very important, particularly in target shooting competition and in certain law enforcement situations. To increase the speed with which a firearm may be withdrawn from its holster, holsters have been reduced in size generally, and also provided with cut-away or open portions in addition to the primary opening. For example, a target shooting competition type holster may include a front opening or cut-away portion in addition to the primary opening. The front opening allows the barrel of the firearm to be leveled somewhat as the firearm is withdrawn, and this efficiency of movement decreases the time required to draw and bring the weapon to bear upon a target.

Although reducing the size of the holster and including open or cut-away portions may generally allow the firearm to be unholstered more quickly, such open portions decrease or even eliminate the support of the firearm in the holster. Thus, holsters incorporating such open or cut-away portions are generally unable to hold the weapon steady. The poorly supported firearm may rock back and forth within the holster as it is carried, or may even fall completely out of the holster in some cases.

It is therefore, a general object of the invention to provide an apparatus and method for use with firearm holsters adapted to overcome the above described problems and others associated with holding the firearm steady within the holster, particularly in competition or speed holsters having minimal support for the weapon.

SUMMARY OF THE INVENTION

A holster locking apparatus according to the invention is adapted to be fitted to a holster for securely holding a firearm or the like received in the holster. The locking apparatus includes locking means for contacting the firearm when it is received in the holster so as to position or retain the firearm securely against a portion of the holster. This contact between the locking means and the firearm in the holster prevents the firearm from moving or rocking substantially in the holster but does not prevent the weapon from being withdrawn. Activating means are also included in the locking apparatus according to the invention for moving the locking means into contact with the firearm received in the holster, preferably automatically as the weapon is inserted into the holster.

The preferred locking means includes a locking lever or member positioned within the holster. The locking member is movably secured to the holster and adapted to move between an unlocked position in which it lays generally adjacent an inner surface of the holster, and a locked position in which the locking member extends into the firearm receiving area of the holster. In the locked position, the locking member contacts a portion of the firearm received in the holster so as to securely retain the firearm against a portion of the holster.

In some forms of the invention the activating means is adapted for manually moving the locking member to the locked position as or after the firearm is inserted into the holster. However, the preferred activating means includes an activating member, also positioned within the holster, and adapted to move between an unactivated position and an activated position. In the unactivated position, the activating member extends generally transversely into the firearm receiving area of the holster in position to contact and be displaced by some portion the firearm as it is inserted into the holster. In the activated position, the activating member is displaced downwardly by the firearm received in the holster. Further, the activating member is connected to the locking member by suitable means so that when the activating member is in the unactivated position, the locking member is in the unlocked position, and as the activating member is displaced to the activated position by insertion of the firearm into the holster, the locking member is moved to the locked position.

In the preferred form of the invention, the activating member is positioned within the holster in the unactivated position to contact a portion of the firearm trigger guard as the weapon is inserted into the holster. Also, the locking member is preferably adapted to contact a portion of the inner surface of the trigger guard to hold the weapon securely against a back portion of the holster. The locking member may also include a curved portion that enables the member to move smoothly from the unlocked to locked position without interfering with the insertion of the firearm into the holster and also helps cam the firearm into place.

Preferably, the locking member and activating member are connected by a generally cylindrical pivot section. The pivot section is connected to an inner surface of the holster, preferably by a suitable clamp member, so that it may rotate about its longitudinal axis. This pivot action of the pivot section allows the preferred coordinated movement of the activating member and the locking member.

Where the locking member contacts a portion of the trigger guard inner surface when in the locked position, such member is automatically moved back to the unlocked position as the firearm is withdrawn from the holster. This movement of the locking member from the locked position to the unlocked position also returns the activating member to its unactivated position thereby making the holster ready to receive and lock the weapon again when desired.

In another preferred form, the locking apparatus includes biasing means for biasing the locking member toward the unlocked position. The biasing means thus helps return the locking member to the unlocked position and the activating member to the unactivated position when the firearm is withdrawn from the holster. In its preferred form, the biasing means comprises a spring positioned on the pivot section and adapted to act between the activating member and the clamp member or holster. However, any suitable biasing arrangement may be used, such as a coil spring acting between the clamp member and the pivot section.

The method of the invention includes first displacing the activating member from the unactivated position t the activated position. The method also includes extending the locking member into the holster as the activating member is displaced so as to contact the firearm and retain the firearm securely against a portion of the holster.

As mentioned above, the step of displacing the activating member from the unactivated position to the activated position, is preferably performed by contacting the activating member with the firearm trigger guard as the weapon is inserted into the holster. Also, the step of extending the locking member includes contacting a portion of the inner surface of the trigger guard with the locking member.

The method of the invention further includes the step of retracting the locking member by contact with the firearm trigger guard as the firearm is withdrawn from the holster, and also the step of moving the activating member back to its unactivated position as the locking member is retracted.

As an alternative to or in addition to retracting the locking member back to its unlocked position by contact with the firearm as it is removed from the holster, the step of retracting the locking member may be performed with biasing means such as a suitable spring acting between either the locking or activating member and the holster or clamp member described above.

These and other objects, advantages, and features of the invention will be apparent from the following description of the preferred embodiments, considered along with the accompanying drawings.

DESCRIPTION OF THE PREFERRED EMBODIMENTS

Figure 1:
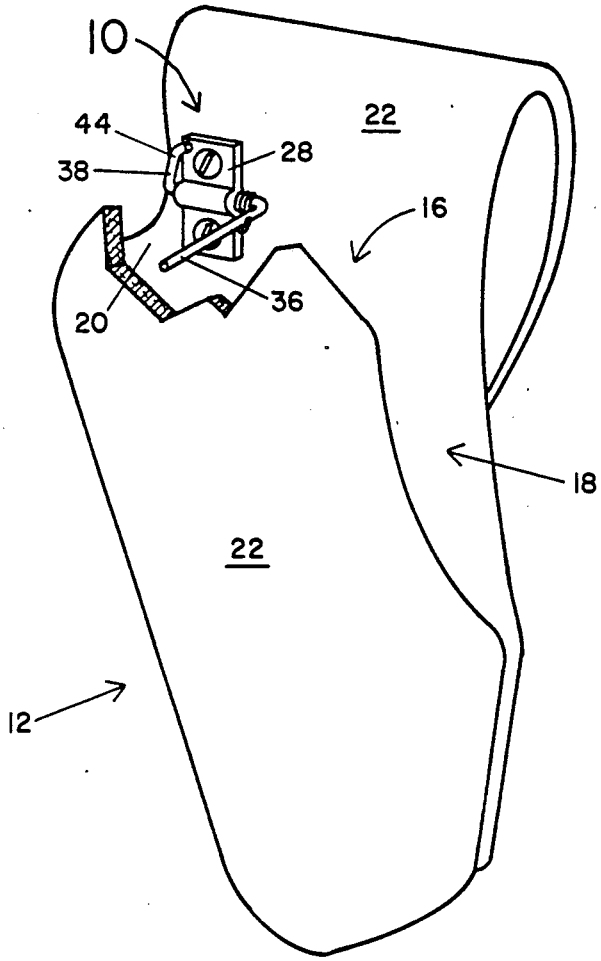
FIG. 1 is a view in perspective of a holster partially cut away to show a locking apparatus embodying the principles of the invention.

FIGS. 1–4 illustrate the preferred form of locking apparatus according to the invention, generally indicated at reference numeral 10. Referring particularly to FIG. 1, the locking apparatus 10 is mounted on a holster 12. The holster 12 includes a receptacle area for receiving a firearm or the like, in this case, a pistol, and a top opening 16 through which a firearm may be inserted into the receptacle or firearm receiving area. The illustrated holster 12 also includes a front opening or cutaway portion 18 adapted for decreasing the time required for withdrawing a pistol from the holster and bringing it to bear upon a target. The holster 12 also includes a rear wall 20 and side walls 22 to provide support for a pistol received in the holster.

Figure 2:
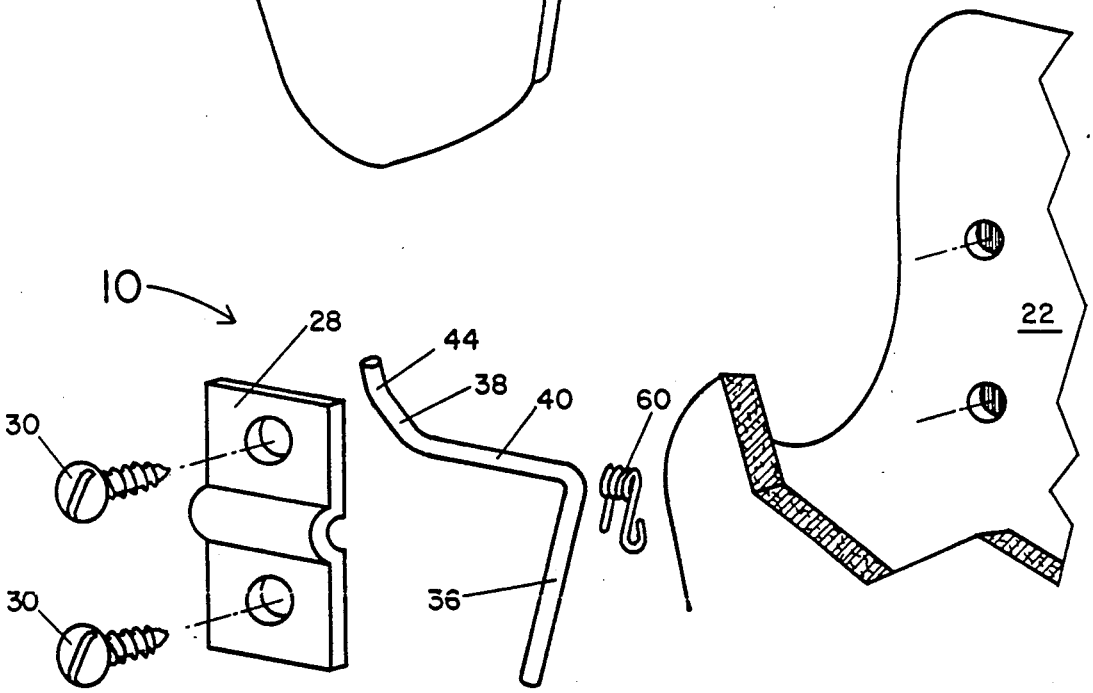
FIG. 2 is an enlarged exploded view in perspective showing the locking apparatus of FIG. 1.
Figure 3:
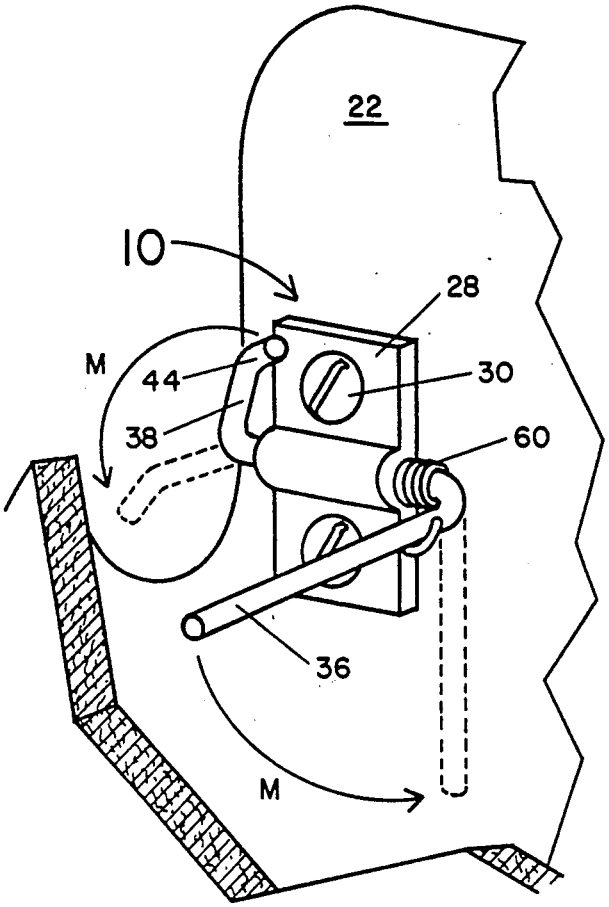
FIG. 3 is an enlarged partial view in perspective of the locking device and holster shown in FIG. 1, indicating the movement of the locking apparatus from the unlocked to the locked position.

As shown in each figure, but perhaps best in FIGS. 2 and 3, the preferred locking apparatus 10 is secured to the inner surface of one of the side walls 22 by attachment means. In this preferred form of the invention, the attachment means includes a clamp or base member 28 adapted to be fastened to the holster wall 22 by screws 30.

The illustrated preferred locking apparatus 10 also includes activating means including an activating member 36, and locking means including a locking member 38 having a somewhat curved portion 44 at its end. The activating member 36 and locking member 38 are connected in this form of the invention by a generally cylindrical pivot section 40 which is adapted to be rotatably mounted against the holster wall 22 by the clamp or base member 28. Preferably, the activating member 36, locking member 38, and pivot section 40 are integrally formed from a rigid piece of material, bent or otherwise formed into the desired shape. For example, the material may be a suitable metal wire bent into the illustrated shape.

In the illustrated form of the invention, the activating member 36 extends at approximately a 90° angle to the longitudinal axis of the pivot section 40. The locking member 38 also extends at approximately a 90° angle to the longitudinal axis of the cylindrical pivot section 40, but generally perpendicular to the activating member 36. However, it will readily be appreciated by those skilled in the art that the activating and locking members 36 and 38, respectively, may be oriented at other angles most appropriate for the geometry of the particular weapon in use. Furthermore, the activating member and locking member need not be connected by the specific pivot section 40 illustrated, but may be connected in any manner adapted to move the locking member to the locked position in response to movement of the activating member.

Referring to FIGS. 1 and 3, the activating member 36 is adapted to be positioned in an unactivated position in which it extends generally transversely into the firearm receiving area of the holster. In this extended, unactivated position, the activating member 36 is in position to be contacted and displaced downwardly by a pistol as the pistol is inserted into the holster 12 through the holster top opening 16. When the activating member 36 is in the unactivated position shown in FIGS. 1 and 3, the locking member 38 is adapted to reside in an unlocked position in which it lays generally adjacent the inner surface of the holster wall 22.

Figure 4:
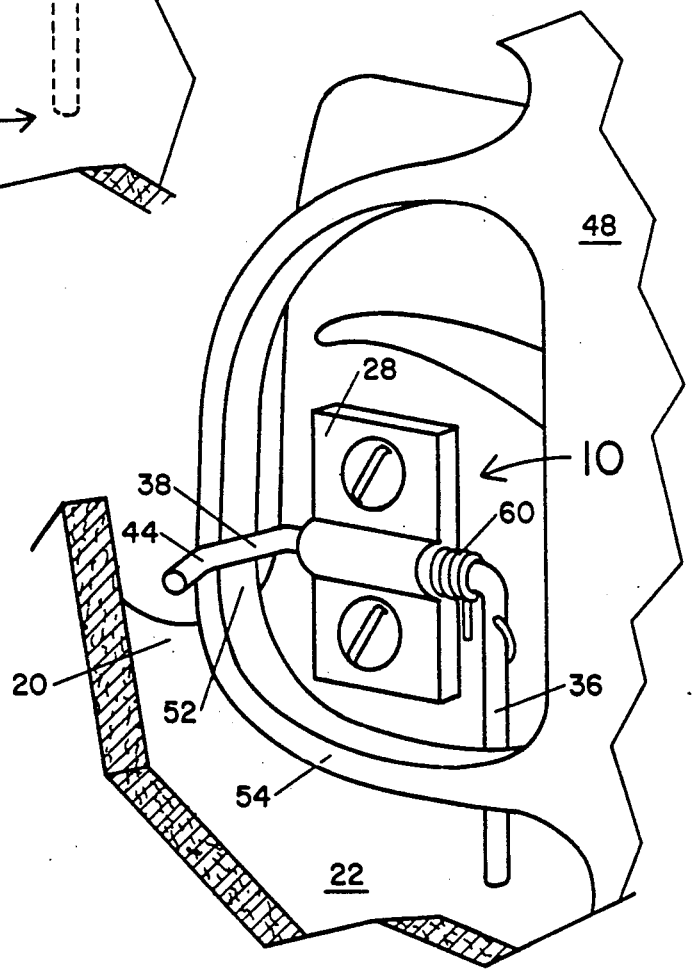
FIG. 4 is an enlarged partial view in perspective of the holster and locking apparatus shown in FIG. 1, but with the locking device in a locked position and with a pistol received and locked in the holster with the locking apparatus.

Referring now to FIGS. 3 and 4, the locking apparatus 10 is adapted to move as indicated by arrows M in FIG. 3, from the unlocked position to a locked position when a firearm, in this case, a pistol 48, is received in the holster 12 through the holster top opening 16. When the locking apparatus 10 is in the locked position, shown in FIG. 4 and shown in phantom in FIG. 3, the activating member 36 is displaced or pivoted downwardly toward the holster wall 22 to an activated position. This downward displacement of the activating member 36 also rotates the pivot section 40 within its mount in the clamp 28 and extends or pivots the locking member 38 from the unlocked position shown in FIG. 1 to a locked position shown best in FIG. 4. In the locked position, the locking member 38 is adapted to extend into the firearm receiving area of the holster 12 and to contact the pistol 48 so as to hold the pistol tightly against a portion of the holster. In the illustrated form of the invention, the locking member 38 is adapted to contact an inner surface 52 of the firearm trigger guard 54 and to hold or retain the trigger guard, and thus the pistol, tightly against the rear wall 20 of the holster 12. The curved portion 44 of the locking member 38 is adapted to fit the shape of the area on the weapon that it contacts, and is also adapted to help cam the weapon into position in the holster as the weapon is inserted from various angles.

As may be appreciated from FIG. 4, the pistol 48 inserted in the holster 12 and locked by the locking apparatus 10 may not rock forward in the holster even though the front opening or cutaway portion 18 provides very little front support. Yet, the pistol 48 may easily and quickly be removed from the holster 12 through the top opening 16. As the pistol 48 is pulled upwardly, the pistol trigger guard 54 moves or displaces the locking member 38 upwardly and returns the locking member to the unlocked position shown in FIG. 1. This movement of the locking member 38 also returns the activating member 36 back to the unactivated position. Thus, removing or drawing the pistol 48 automatically returns the locking apparatus 10 to the unlocked position shown in FIG. 1, ready to accept and lock the pistol 48 when it is once again inserted into the holster.

The illustrated locking apparatus 10 also includes biasing means, in this form of the invention a spring 60, for biasing the locking member 38 to the unlocked position shown in FIG. 1. The biasing force of the spring 60 helps return the locking member 38 completely to the unlocked position generally adjacent the holster wall 22. In the illustrated preferred form of the invention, the spring 60 is positioned on the pivot member 40 and connected so as to act between the activating member 36 and the wall 22 of the holster 12. Alternatively, the biasing means may comprise a coil spring adapted to operate between the pivot section 40 and clamp 28. Further biasing arrangements, such as a spring acting directly between the locking member and the clamp, or a flat spring acting upon one or both of the members 36 or 38, for example, may also be used within the scope of the invention.

Although the illustrated embodiment described above is adapted to prevent forward movement of the firearm in the particular holster, other embodiments may restrict other types of movement. For example, some holsters may be adapted for a forward drawing motion, with no upward motion with respect to the holster desired. In this case the locking member according to the invention is adapted to contact the weapon in the holster to prevent up and down movement, but to allow the desired forward drawing motion. Generally, the locking apparatus of the invention may be adapted to restrict firearm movement and removal in any desired direction.

In other forms of the invention, the activating means or member may be positioned outside of the holster and adapted to be operated manually rather than automatically as described above. In these alternate forms, the operator may lock the firearm in place with the locking member either as the weapon is inserted into the holster, or after insertion.

The method of the invention may now be described with reference to FIGS. 1-4. The preferred method includes first displacing the activating member 36 with the pistol 48 as the pistol is inserted into the holster 12 through the holster top opening 16. The method also includes extending the locking member 38 as the activating lever 36 is displaced so that the locking member extends into the firearm receiving area of the holster 12 to contact a portion of the pistol 48 and to retain the pistol securely against a portion of the holster.

In the preferred method of the invention, the activating member 36 is displaced by contact with the pistol trigger guard 54 as the pistol 48 is inserted into the holster 12. The step of extending the locking member 38 is preferably accomplished by the connection, in this embodiment through the pivot section 40, between the activating member 36 and the locking member 38. Also, in the illustrated preferred form of the invention, the locking member 38 is adapted to contact the inner surface 52 of the trigger guard 54 to retain the pistol 48 against the rear wall 20 of the holster 12.

The method of the invention also includes retracting the locking member 38 as the pistol 48 is removed from the holster 12. The step of retracting the locking member 38 may be performed as the pistol is removed with a portion of the pistol, preferably the trigger guard, contacting the locking member so as to move it back to the retracted or unlocked position shown in FIG. 1. The step of retracting the locking member 38 also preferably includes simultaneously moving the activating member 36 back to its unactivated position.

The preferred method of the invention also includes the step of biasing the locking member 38 toward the unlocked position shown in FIG. 1 by suitable means. This biasing step insures that the locking member 38 is returned completely to the unlocked position when the pistol 48 is withdrawn from the holster 12. Preferably, the spring 60 is positioned on the pivot section 40 to bias the locking member 38 toward the unlocked position. Alternatively, a coil spring (not shown) may be used to bias the locking member 38 according to the invention.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A firearm holster locking apparatus comprising:

A. locking means movably secured to the holster and adapted to move between a locked position and an unlocked position, the locking means, when in the locked position, for limiting the movement of a firearm received in the holster in at least one direction other than a withdrawal direction in which the firearm is withdrawn from the holster; and B. activating means connected to the locking means for contacting the firearm as it is inserted into the holster so as to move the locking means from the unlocked to the locked position and for contacting the firearm received in the holster to retain the locking means substantially in the locked position.

2. The firearm holster locking apparatus of claim 1 wherein:

A. the locking means is also for moving from the locked position to the unlocked position as the firearm received in the holster is withdrawn there from.

3. The firearm holster locking apparatus of claim 2 wherein the activating means comprises an activating member adapted to extend into the holster in an unactivated position when the locking means is in the unlocked position, in which unactivated position the activating member may be contacted and displaced by the firearm as the firearm is inserted into the holster.

4. The firearm holster locking apparatus of claim 3 wherein the locking means comprises a locking member adapted to extend generally transversely into the holster when in the locked position, the locking member being connected to the activating member and having a longitudinal axis extending generally perpendicular to the activating member.

5. The firearm holster locking apparatus of claim 4 wherein the activating member, when in the unactivated position, is adapted to be contacted and displaced by the firearm trigger guard as the firearm is inserted into the holster.

6. The firearm holster locking apparatus of claim 5 wherein the locking member extends through the trigger guard, when in the locked position with the firearm received in the holster, so as to contact a portion of the trigger guard inner surface and press the trigger guard securely against a back portion of the holster to substantially prevent forward rocking of the firearm in the holster.

7. The firearm holster locking apparatus of claim 6 wherein the locking member is pivotally connected to the holster and is adapted to pivot between the extended locked position and the unlocked position in which the locking member is retracted so as to lay substantially parallel to the holster inner surface.

8. The firearm holster locking apparatus of claim 7 wherein the locking member includes a curved portion for helping to prevent the locking member from catching on the trigger guard as the locking member pivots to the locked position and for helping cam the firearm into position in the holster.

9. The firearm holster locking apparatus of claim 8 wherein the activating member is pivotally connected to the inner surface of the holster and is adapted to pivot between the unactivated position and an activated position in which the activating member is pivoted downwardly by the firearm inserted in the holster.

10. The firearm holster locking apparatus of claim 9 wherein the activating member and the locking member are connected by a generally cylindrical pivot section rotatably secured to the inside wall of the holster to allow the pivot movement for both the locking member and the activating member.

11. The firearm holster locking apparatus of claim 10 further including a suitable spring mounted on the pivot member so as to act between the activating member and the holster.

12. The firearm holster locking apparatus of claim 4 wherein:

A. the locking member is adapted to move in a direction generally opposite to the withdrawn direction as it moves from the unlocked position to the locked position; and B. the locking member is adapted to move generally in the withdrawal direction as it moves from the locked position to the unlocked position.

13. A method of releasably locking a firearm in a holster so that the firearm may not move within the holster but may be quickly withdrawn, the method comprising the steps of:

A. displacing an activating member in one direction of movement by simultaneous contact with the firearm as the firearm is inserted into the holster;

B. extending a locking member into the holster to a locked position as the activating member is displaced in said one direction of movement; and C. limiting the movement of the firearm received in the holster in at least one direction of movement other than a withdrawal direction with the locking member when the locking member is extended to the locked position.

14. The method of claim 13 including the step of retracting the locking member at least partially from the holster with a suitable biasing spring as the firearm is withdrawn from the holster.

15. The method of claim 13 including the step of retracting the locking member by contact between the locking member and the firearm as the firearm is withdrawn from the holster.

16. A firearm holster locking apparatus comprising:

A. locking means movably secured to the holster for residing in a locked position in which it limits the movement of a firearm received in the holster in at least one direction other than the direction in which the firearm is withdrawn from the holster, and for residing in an unlocked position in which it does not impede the insertion of the firearm into the holster; and B. activating means connected to the locking means for contacting the firearm as it is inserted into the holster and for moving the locking means in a single direction of movement from the unlocked to the locked position by the contact between the activating means and the firearm as the firearm is inserted into the holster.

17. The firearm locking apparatus of claim 16 wherein:

A. the locking means comprises a locking member pivotally connected to the holster;

B. the activating means comprises an activating member connected to the locking member and extending at generally a right angle to the locking member.

18. The firearm locking apparatus of claim 16 wherein:

A. the activating means is also for contacting the firearm when the firearm is received in the holster and such contact holds the locking means in the locked position.

19. A firearm holster locking apparatus comprising:

A. a locking member pivotally connected to the holster and adapted to pivot between a locked position in which it extends into the holster to limit the movement of a firearm received therein, and an unlocked position in which it is substantially retracted from the holster;

B. an activating member connected to the locking member and adapted to contact and be displaced by the firearm as the firearm is inserted into the holster so as to pivot the locking member from the unlocked to the locked position by such contact; and C. biasing means for biasing the locking member to the unlocked position so as to reduce the resistance provided by the locking member to the withdrawal of the firearm from the holster.

* * * * *